US005620179A

United States Patent [19]

MacKay, Jr.

[11] Patent Number: 5,620,179

[45] Date of Patent: Apr. 15, 1997

[54] LAMINATED WOOD BAT AND METHOD OF MAKING SAME

[76] Inventor: Jack W. MacKay, Jr., Rte. 9, Box 185, Mt. Pleasant, Tex. 75455

[21] Appl. No.: 510,847

[22] Filed: Aug. 3, 1995

[51] Int. Cl.[6] ..... A63B 59/06

[52] U.S. Cl. ..... 473/564

[58] Field of Search ..... 273/72 R, 26 B

[56] References Cited

U.S. PATENT DOCUMENTS

| | | | |
|---|---|---|---|
| 1,121,189 | 12/1914 | Lincoln | 273/72 R |
| 1,450,646 | 4/1923 | Sadenwater | 273/72 R |
| 1,603,904 | 10/1926 | Cohn | 273/72 R |
| 2,793,859 | 5/1957 | Darling et al. | 273/72 R |
| 4,572,508 | 2/1986 | You | 273/72 R |
| 4,844,460 | 7/1989 | Mitchell et al. | 273/72 R |
| 5,114,144 | 5/1992 | Baum | 273/72 R |
| 5,165,686 | 11/1992 | Morgan | 273/72 R |

FOREIGN PATENT DOCUMENTS 22649 7/1948 Finland .

*Primary Examiner*—Mark S. Graham

*Attorney, Agent, or Firm*—Jacobson, Price, Holman & Stern, PLLC

[57] ABSTRACT

A laminated wood ball bat and a method of making the same. The bat is constructed of a plurality of thin wood veneer strips extending longitudinally in generally parallel relation throughout the length of the bat and are bonded together throughout their facing surfaces. The method of forming the bat includes the steps of placing large sheets of thin wood veneer in stacked relation in the cavity of a press with glue being applied to the contacting surfaces of the stacked sheets of veneer. The press exerts pressure on the veneer sheets to densify and compress the stacked veneer sheets while the glue is cured to form a large laminated panel having a thickness of half bat billets. One surface of each half bat billet panel is optionally grooved to form a core in the hitting zone to optionally receive material less dense or more dense than the wood veneer and a recess in the handle portion to receive a reinforcing rod. Two half bat billet panels are placed in a press cavity with the facing surfaces being glue coated to form a laminated full thickness bat billet panel which is then cut into substantially identical square bat billets. The laminated square, cured bat billets are formed into the desired bat configuration in a lathe and a final finish is applied.

17 Claims, 7 Drawing Sheets

LAMINATED WOOD BAT AND METHOD OF MAKING SAME

BACKGROUND OF THE INVENTION

1. Field of the Invention

The present invention relates to a laminated wood ball bat, especially for baseball and soft ball, and a method of making the same. The bat is constructed of a plurality of thin wood veneer strips extending longitudinally in generally parallel relation throughout the length of the bat which are bonded together throughout their facing surfaces. The method of forming the bat includes the steps of placing large sheets of thin wood veneer in stacked relation in the cavity of a press with glue being applied to the contacting surfaces of the stacked sheets of veneer. The press exerts pressure on the veneer sheets to densify and compress the stacked sheets while the glue is cured to form a large laminated panel having a thickness of half bat billets. One surface of each half bat billet panel can be optionally grooved to form a core in the hitting zone and a recess receiving a reinforcing rod in the handle. Two half bat billet panels are then placed in a press cavity with the facing surfaces being glue coated to form a laminated full thickness bat billet panel which is then cut into substantially identical square bat billets. The laminated square, cured bat billets are then formed into the desired bat configuration in a lathe and a final finish is applied.

2. Description of the Prior Art

Wood baseball and softball bats have been used for many years and usually are constructed from a billet of cured Ash wood formed to proper dimensional characteristics by the use of a lathe in a well known manner. Availability of the raw material used in making wood bats has materially diminished and the cost of the raw material has materially increased resulting in efforts to construct ball bats from alternative materials. Hollow metal bats of aluminum have been developed and are in wide use, especially at subprofessional levels. Also, efforts have been made to construct ball bats of laminated wood components as well as other composite materials.

For example, U.S. Pat. No. 4,844,460 discloses a wood bat constructed of four longitudinal quarter billets with each billet having a square transverse cross-sectional configuration. The longitudinal quarter billets are glued together to form a square composite billet which is subsequently shaped to a desired bat configuration. This patent discloses in great detail how the physical characteristics of the bat are obtained.

In another U.S. Pat. No. 4,572,508, a laminated wood bat is disclosed which is constructed of a plurality of wood plates with layers of carbon fiber webs impregnated with a resin sandwiched between the plates. Also, the plates are joined together along their facing surfaces by dovetail interlocking ribs and grooves. The plates are relatively thick in that four plates are disclosed to form the bat in this patent.

Finally, U.S. Pat. No. 5,114,144 discloses a wood composite bat having a central core of foam plastic or aluminum, an inner layer of resin impregnated fiber and an outer layer of longitudinally extending strips of veneer laid in side-by-side abutting relation to form the outer contour of the bat without overlap of the strips.

Other patents are also of interest, including U.S. Pat. Nos. 5,165,686 and 4,199,632 and Finnish Patent No. 22649. The prior art does not disclose a bat constructed in accordance with the present invention, nor the method of forming the laminated wood bat by assembling a plurality of large sheets of wood veneer into a glued stack billet panel which is then cut into laminated bat billets.

SUMMARY OF THE INVENTION

The present invention includes a laminated wood bat constructed of a plurality of thin wood veneer strips extending longitudinally of the bat. The veneer strips are positioned substantially parallel with the wood grain in all the veneer strips extending longitudinally or the wood grain in some or every other veneer strip extending transversely. The veneer strips are stacked together with glue covering substantially the entire surface between adjacent strips. The stack is placed in a press and the glue is cured while the press exerts a compression force on the sheets of veneer to form a large panel of veneer strips with the wood grain in each veneer strip extending longitudinally in the same direction or the wood grain in some or every other veneer strip extending transversely. The panel is then cut longitudinally into a plurality of elongated billets having a generally square cross-section. Each billet is then final shaped into a desired bat configuration to form a completed laminated wood bat.

Therefore, it is a principal object of the present invention to provide a laminated wood bat constructed of a plurality of thin wood veneer strips oriented in stacked, generally parallel, longitudinal relation with adjacent strips surfaces having a layer of glue thereon for securely bonding the thin veneer layers together to form the bat.

Another object of the invention is to provide a laminated wood bat in accordance with the preceding object in which the laminated construction is substantially stronger than one piece bats and will not split in the event of breakage inasmuch as the laminations bend and remain connected rather than completely breaking the bat into two pieces which can cause injury to other ball players or to spectators when a portion of the bat flies away from the batter's hands.

A further object of the invention is to provide a laminated wood bat in accordance with the preceding objects in which the veneer strips have a thickness generally ranging from about 1/64 inch up to and including about ½ inch with the bat being transversely and longitudinally solid or alternatively with an internal core in the hitting zone. An internal core can be readily incorporated into the laminated bat during construction so that it is not visible from the exterior of the bat and can be of any length and any size and less dense than the wood, such as being hollow or filled with a foam plastic material or more dense than the wood, such as being provided with an internal weight member, to provide the desired weight and balance characteristics to the bat.

An additional object of the invention is to provide a laminated wood bat optionally with a core or recess formed in the handle in which a reinforcing rod is placed to regulate the flexibility and rigidity of the handle portion of the bat.

Still another object of the present invention is to provide a method of forming a wood laminated bat by assembling a plurality of sheets of thin wood veneer in a press with a layer of glue applied to engaging surfaces of the sheets, applying pressure while curing the glue to form a laminated panel with the thickness corresponding to one side of the square cross section of a generally elongated billet from which the bat is formed. The cured panel is next cut into a plurality of equal size elongated billets having a width equal to the other side of the square cross section. The billets are then shaped to the desired final bat configuration in a lathe.

A still further object of the invention is to provide a method of forming a laminated wood bat in accordance with the preceding object in which a hollow core or recess are formed in the bat when two laminated half panels are formed from a plurality of laminated veneer sheets. One or more longitudinal recesses are formed in one surface of each of the two laminated half panels, each of which is one half as thick as a full thickness billet laminated panel. The half billet panels are glued together in a press with the recess or recesses formed in the half billet panels being in registry to form a core and a recess in the completed billet panel. The core is preferably spaced from the end of the completed billet panel which forms the barrel of the bat and the recess, if desired, is also spaced from the handle end of the bat to receive a handle reinforcing rod. The hollow core in the hitting zone and the recess in the handle are terminated inwardly from the respective ends of the bat to provide a laminated wood bat with a continuous external surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
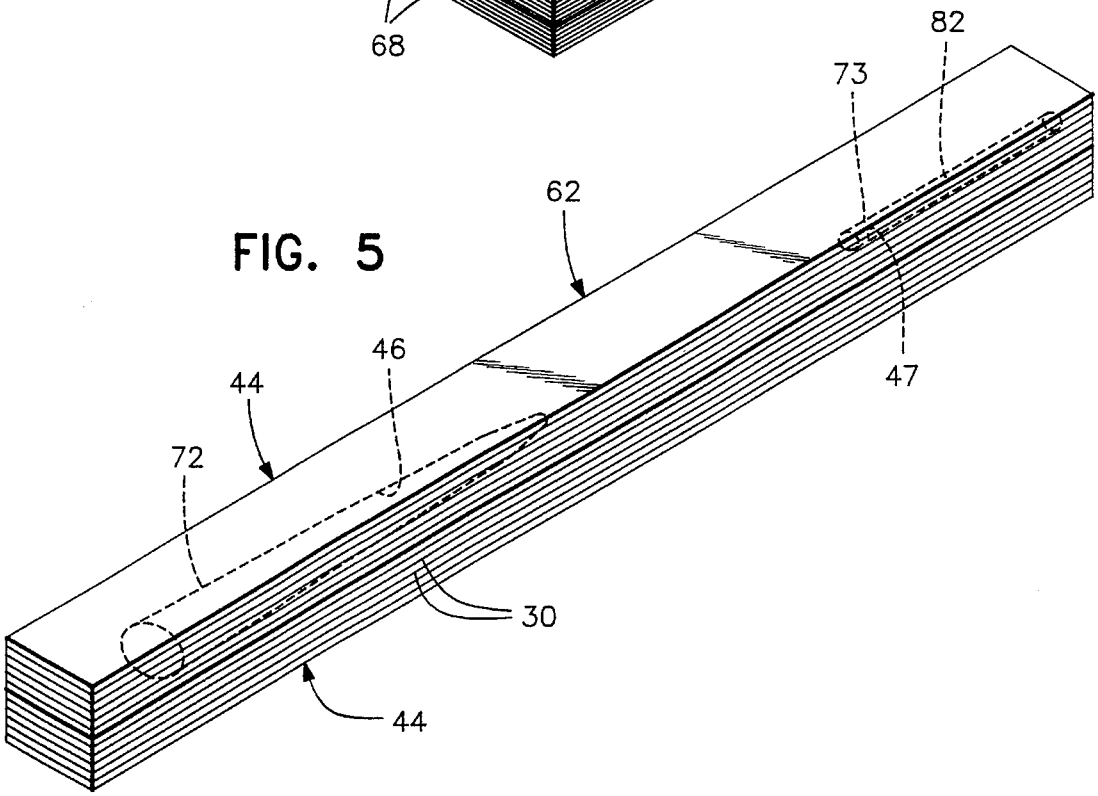
FIG. 5 is a perspective view of a square bat billet with a central core and recess formed therein in accordance with the present invention.
Figure 6:
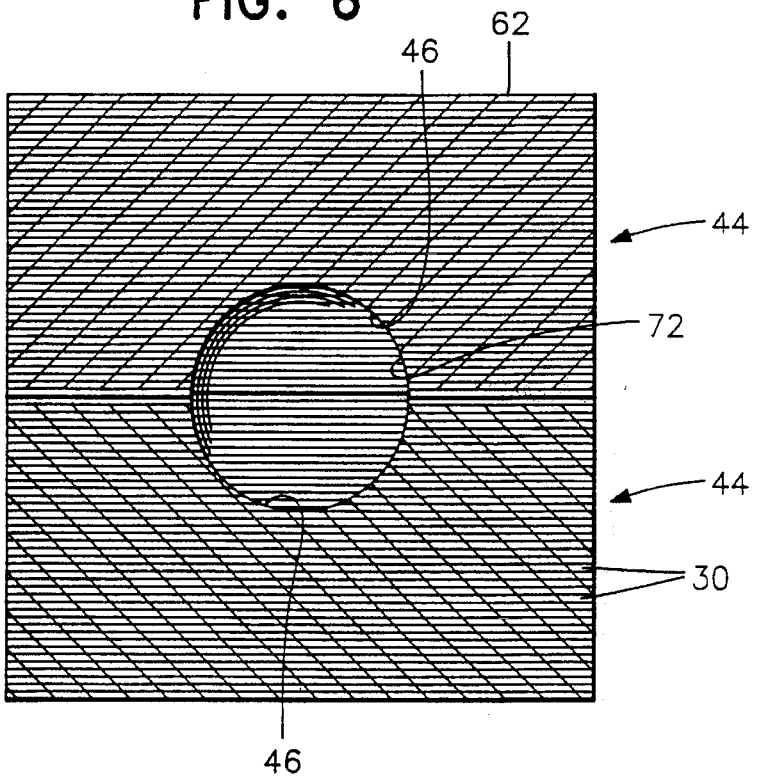
FIG. 6 is a transverse sectional view of a bat billet illustrating the facing recesses defining an internal core in the hitting zone of the bat to be formed from the billet in accordance with the present invention.
Figure 7:
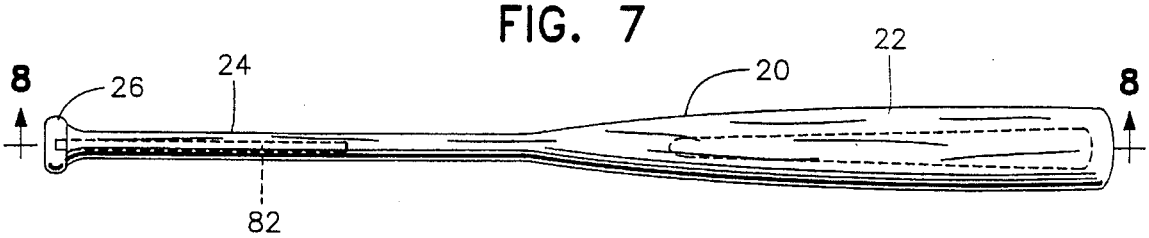
FIG. 7 is a plan view of a laminated wood bat of this invention formed by turning the billet of FIG. 5 in a conventional lathe operation.
Figure 8:
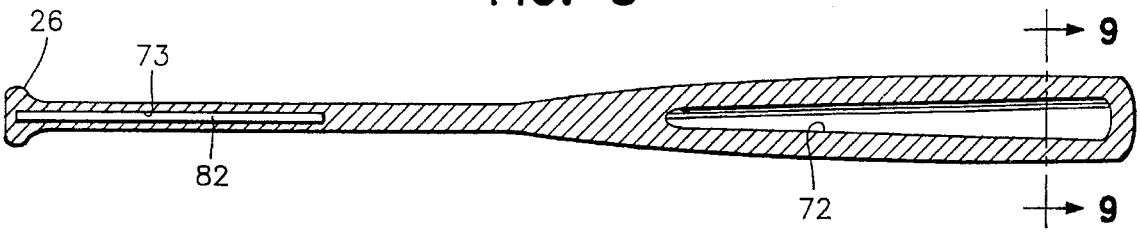
FIG. 8 is a longitudinal, sectional view of the laminated wood bat taken along section line 8—8 on FIG. 7 illustrating a hollow core arrangement and reinforcing rod in the handle recess.

FIGS. 1–6 of the drawings illustrate schematically the method of forming the bat of the present invention and FIGS. 7–14 illustrate the various completed bat structures of this invention. Referring first to FIG. 7, the bat is designated by reference numeral 20 and the external dimensional characteristics are conventional. The bat includes a barrel 22 which defines the hitting zone which tapers smoothly into a handle portion 24 having the usual knob 26 thereon. The overall length of the bat may vary within certain limits, the overall weight of the bat may also vary within certain limits with the barrel portion 22 having a diameter normally up to and including 2 ¾ inch, and the handle portion may have an outside diameter that may vary within limits. The bat 20 conforms with standardized rules of various leagues, associations and the like.

Figure 1:
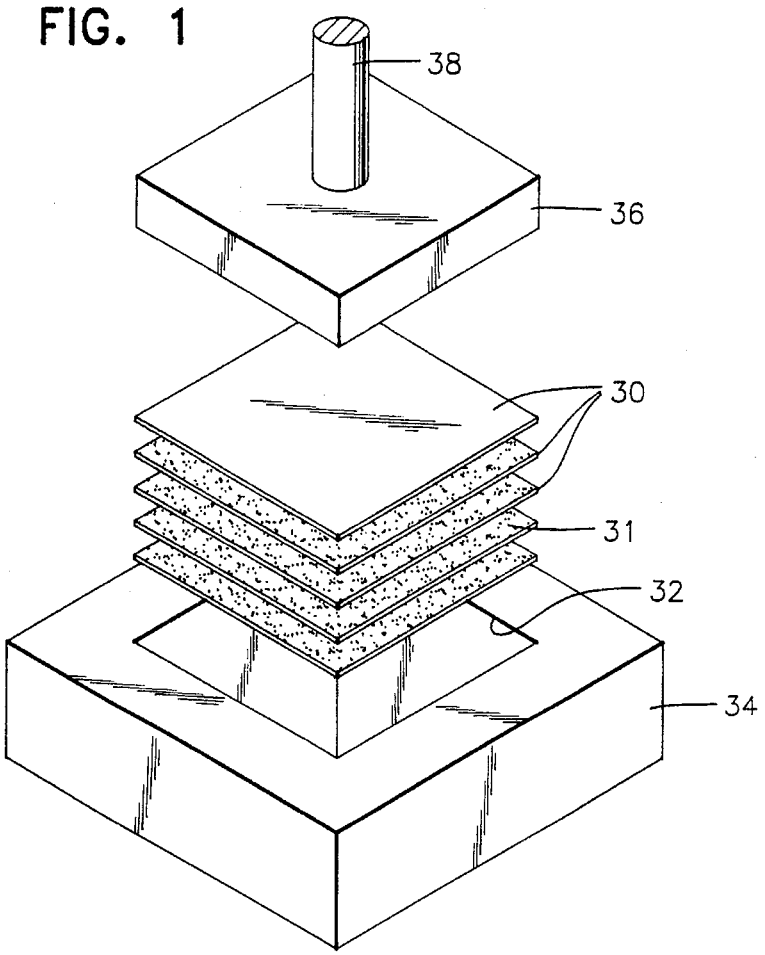
FIG. 1 is a diagrammatic perspective view illustrating a plurality of thin veneer sheets with glue on facing surfaces positioned with respect to a press cavity and a press plate and ram to form a laminated half billet panel in accordance with the present invention.

In constructing the bat 20, rather than using a one-piece bat billet formed from an Ash tree, wood veneer sheets 30 are used which are preferably 36 inches square but can be up to and include 48 inches square and which range in thickness from about 1/64 inch up to and including about ½ inches as shown in FIG. 1. A plurality of the veneer sheets 30 are placed in the cavity 32 of press platen 34 with the surfaces of the stacked sheets 30 which face each other being provided with a layer of glue 31 applied as a thin but continuous coating not over 1/64 inch, by a conventional paint roller or the like. The glue 31 is conventional 2 part epoxy resin. One preferred composition is available from National Casein Co. of Chicago, Ill., or Bordens Packaging and Industrial Products of Bellevue, Wash. Other epoxy resins or non-water-soluble glues useful in adhering wood parts and wood laminates can be used. The number of veneer sheets 30 placed in the cavity 32 will vary depending upon the thickness of the veneer sheets which preferably range between about ⅛ inch and about ¼ inch to regulate the flexibility and rigidity to be comparable to that of a standard Ash wood bat. After the veneer sheets 30 have been assembled, a press plate 36 is engaged with the uppermost veneer sheet and a press ram 38 actuated to compress the sheets 30 and the glue with the press plate exerting approximately a 20 ton compression force.

The veneer sheets 30 all have their wood grain extending in the same direction or some of the veneer sheets or every other veneer strip may have their wood grain extending transversely. The veneer sheets 30 are somewhat porous which enables the glue to penetrate into the interstices in the veneer sheets when the assembly of sheets 30 and glue is compressed in the press which densifies and compresses the wood fibers in the veneer sheets which increase the strength characteristics of the veneer sheets and panel. The assembled, compressed and densified sheets 30 and glue are then subjected to microwave or acoustic energy for curing the glue to form a stable, rigid, laminated wood veneer panel.

Figure 2:
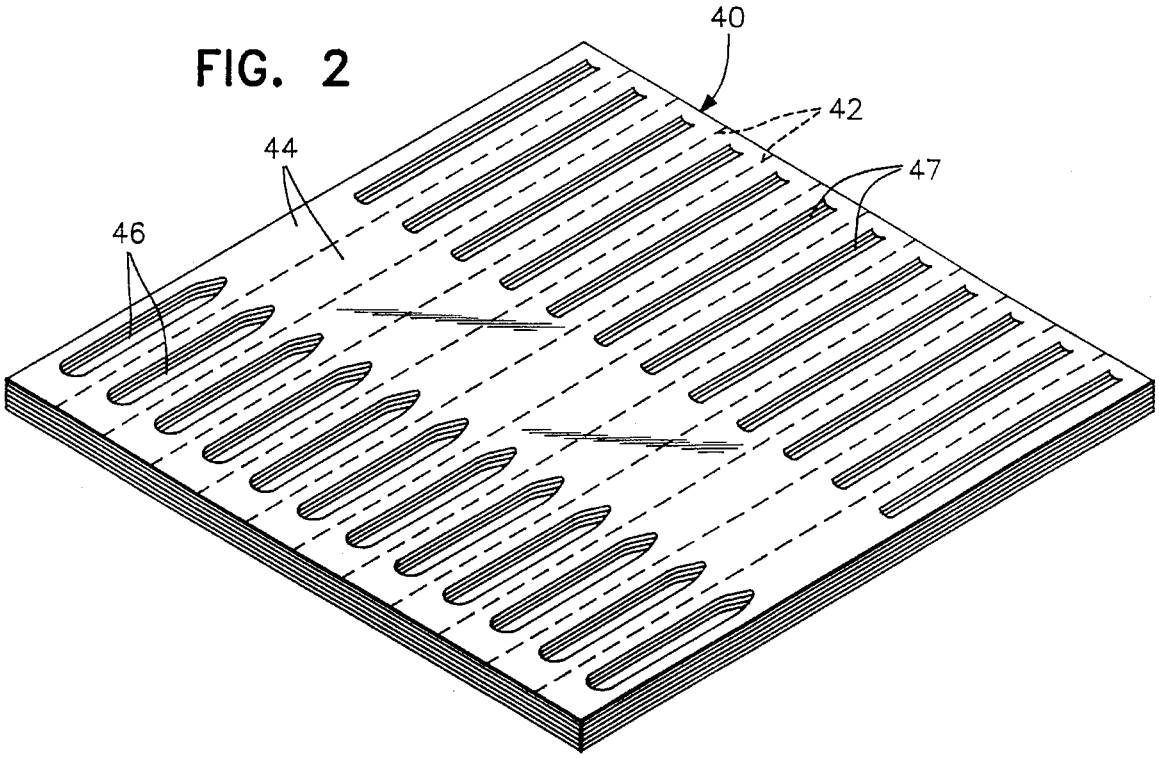
FIG. 2 is a perspective view of the half billet panel of the present invention with recesses being formed in one surface of the half billet panel.

In the preferred form, the completed laminated wood veneer panel is formed by two half thickness panel 40. The total thickness of the compressed, densified and cured veneer half thickness panel 40 is preferably about 1 ½ inches. Therefore, if veneer sheets 30 are ⅜ thick, only three or four panels need be used. If the veneer sheets 30 are 1/64 inch in thickness, approximately forty-eight sheets may be used with the total thickness of the sheets 30 and glue layers being compressed and densified to form a laminated half thickness panel 40 that is approximately 1 ½ inches thick as illustrated in FIG. 2. The laminated half thickness panel 40 is used in forming the laminated wood bat embodiments illustrated in FIGS. 7–14. Preferably veneer sheets having a thickness ranging between about 1/32 inch and about ⅛ inch are used in forming the half thickness laminated panel 40.

Figure 3:
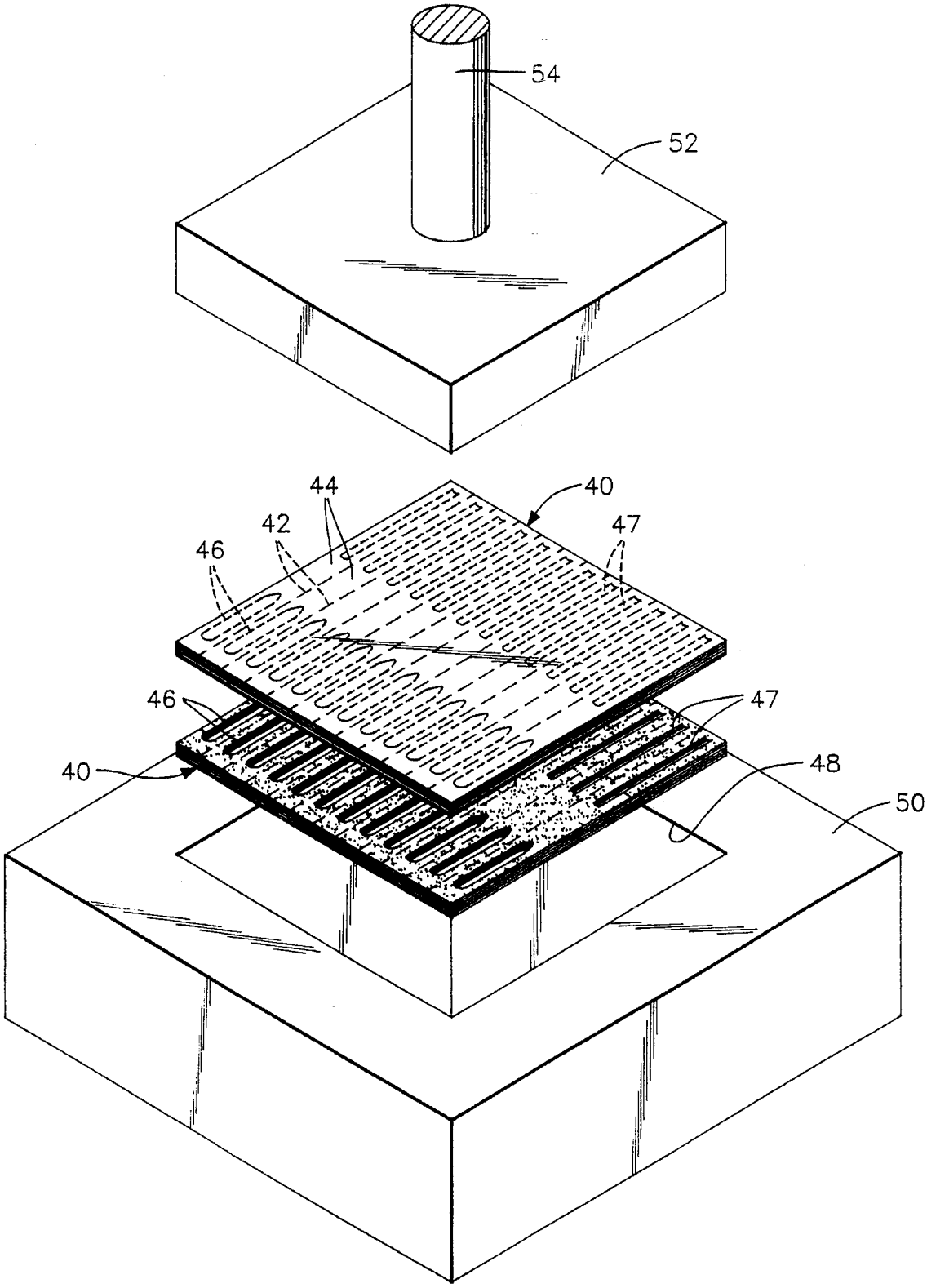
FIG. 3 is a diagrammatic perspective view of two half billet panels oriented in relation to press components with the recesses in the half billet panels in facing relation and the facing surfaces being provided with glue for laminating the half billet panels into a completed full thickness billet panel in accordance with the present invention.

FIG. 2 illustrates schematically by broken lines 42 how the half thickness panel 40 will be cut into half thickness billets 44 which are all preferably about 3 inches wide. However, it will be readily understood that a single half thickness panel 40 will not be cut into half billets. Rather, full size elongated billets 62 are formed only after one half thickness panel 40 is assembled with another corresponding half thickness panel 40 as illustrated in FIG. 3.

Before assembling two half thickness panels 40, each half thickness panel is provided with one or more longitudinally extending grooves or recesses, such as at 46 and 47, by the use of a router or similar apparatus. The length and depth of the grooves or recesses 46 and 47 are determined by the weight and balance characteristics of the finished bat. In forming the recesses or grooves 46 and 47, the transverse cross-sectional configuration is preferably generally semi-cylindrical with the inner ends tapering outwardly to eliminate sharp internal corners in the hitting zone and handle portion of the bat and to merge with the top surface of the panel 40. The outer ends of the grooves or recesses 46 and 47 are generally semispherical and are spaced inwardly from the edge of half thickness panel 40.

Figure 4:
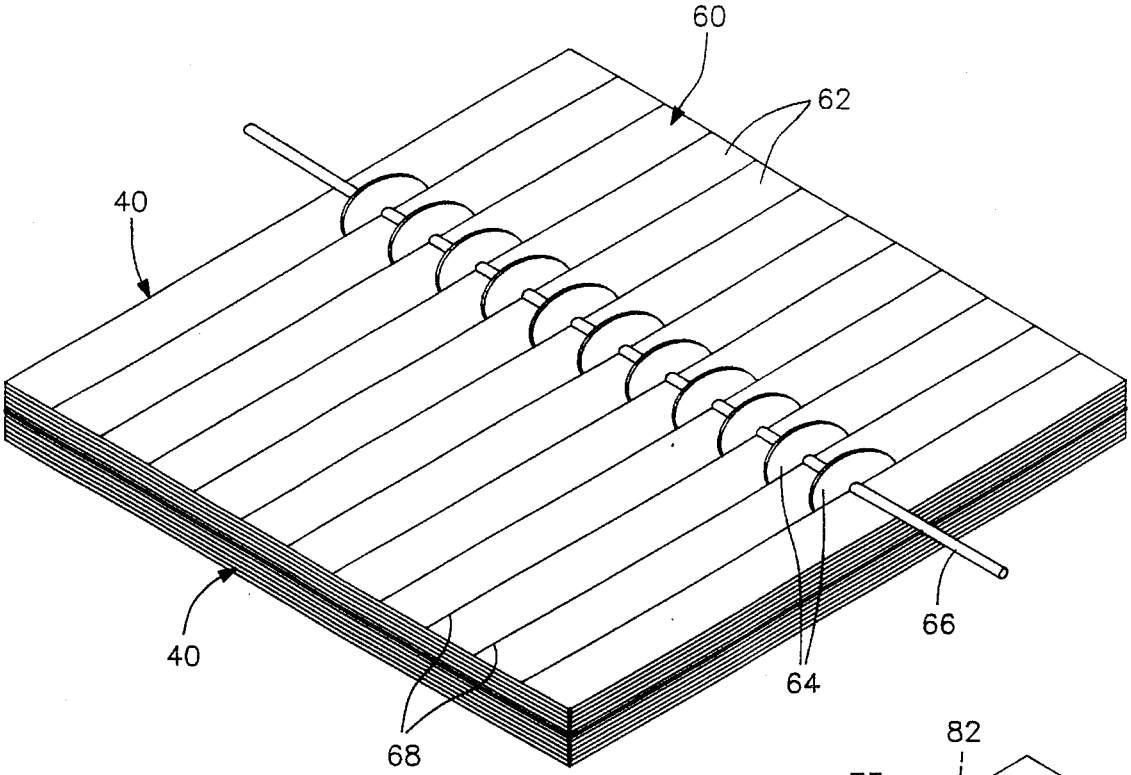
FIG. 4 is a perspective view of a completed full thickness billet panel with a gang saw arrangement schematically illustrated to show a cutting of the billet panel in accordance with the present invention into a plurality of equal sized elongated billets having generally equal square cross-sections.

When the two half thickness panels 40 are assembled in a cavity 48 in a press platen 50, the facing surfaces are provided with a layer of glue and the facing surfaces have the grooves or recesses 46 and 47 oriented in aligned registry with each other inasmuch as all of the recesses and grooves are accurately positioned in the same location with respect to the surface area of each half thickness billet 44. After assembly of the half thickness panels 40 in the press, a press plate 52 and ram 54 are used to apply pressure to the half thickness panels 40 to cause the glue to penetrate into the facing surfaces of the half thickness panels 40. The glue is cured by microwave or acoustic energy to form a completed full thickness panel 60 as illustrated in FIG. 4 in which the total thickness of the full thickness panel 60 is approximately 3 inches resulting from bonding two half thickness panels 40, each approximately 1 ½ inch thick, together by a layer of glue which partially penetrates into the facing surfaces of the half thickness panels 40.

The full thickness panel 60 is then cut into a plurality of full thickness square bat billets 62 by appropriately positioned gang saws 64 mounted on a shaft 66 and operated in a conventional manner to saw the full thickness panel 60 along each of the saw cut lines 68 to form longitudinally continuous full thickness bat billets 62 each of which is preferably approximately 36 inches long, but can be longer, 3 inches wide and 3 inches thick. The grooves or recesses 46 and 47 in each of the half billets 44 are in aligned registry to form either a hollow core 72 in the hitting zone or barrel 22, or a hollow recess 73 in the handle portion 24, or both. A reinforcing rod 82 must be positioned in the bottom recess 47 when the half thickness panels 40 are assembled. Also, if the hollow core 72 is to be filled, the filling material must be placed in the bottom recess 46 when the half thickness panels 40 are assembled.

The reinforcing rod 82 is preferably approximately ¼ inch to ½ inch in diameter and is up to 18 inches long and extends longitudinally from about 1 inch inwardly from the knob end of the bat. The rod is preferably constructed of metal or graphite and regulates the flexibility, rigidity and strength of the handle portion of the bat.

The full thickness bat billet 62 is a stable structure with the laminates formed by the veneer sheets 30 all being generally parallel with all of the wood grain extending longitudinally of the billet or the wood grain of some of or every other one of the laminations extending transversely of the billet. The outer end of the core 72 is spaced from the end of the square full thickness bat billet 62, as illustrated in FIG. 5. FIG. 6 illustrates the cross-sectional structural configuration of the full thickness bat billet 62. The square full thickness bat billet 62 is then placed in a lathe and shaped into the final external shape and configuration of the bat 20 in a well known lathe operation.

The bat 20 as illustrated in FIGS. 7–11 has external dimensional characteristics that can vary as to length and the configuration of the handle and barrel. The core 72 has an outer end terminating inwardly from the barrel end of the bat and an inner end terminating at the inner end of the barrel portion 22 with the dimensional characteristics of the core varying to obtain the desired weight characteristics inasmuch as the glue content of the bat can constitute up to as much as approximately 25% of the bat weight. A conventional Ash wood bat that is 34 inches in length weighs approximately 32 ounces. Thus, the core 72 is dimensioned from zero length up to 14 inches and up to 1 ½ inches in diameter and, preferably, approximately 6 inches to 12 inches in length to provide a laminated bat 20 that is 34 inches long with a weight of approximately 32 ounces.

Figure 9:
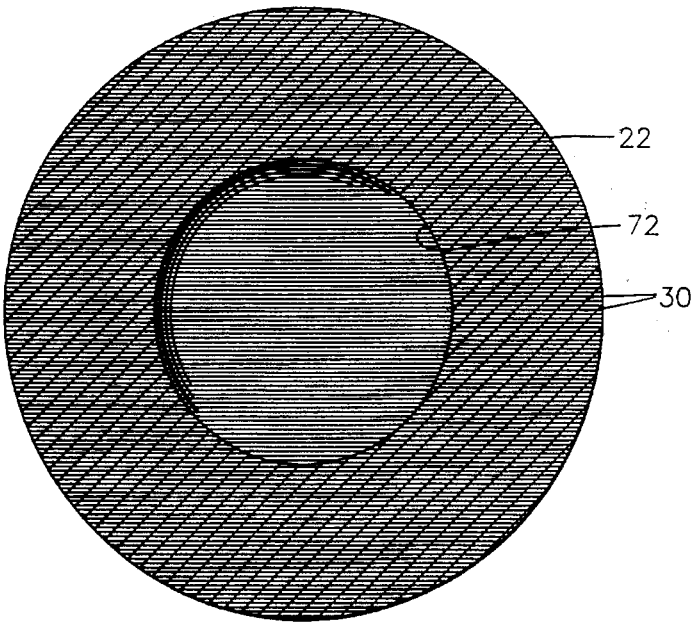
FIG. 9 is a transverse, sectional view, on an enlarged scale, taken along section line 9—9 on FIG. 8 illustrating further structural details of the laminates and hollow core in the hitting zone of the bat.

FIG. 9 illustrates the laminates defined by the wood veneer sheets 30 and illustrates the centered relationship of the core 72 with respect to the external circumference of the barrel portion 22 of the bat which maintains the bat balance with respect to its longitudinal axis. Also, the size, shape and orientation of the core 72 in the bat can be varied to provide the optimum balance point of the bat.

Figure 10:
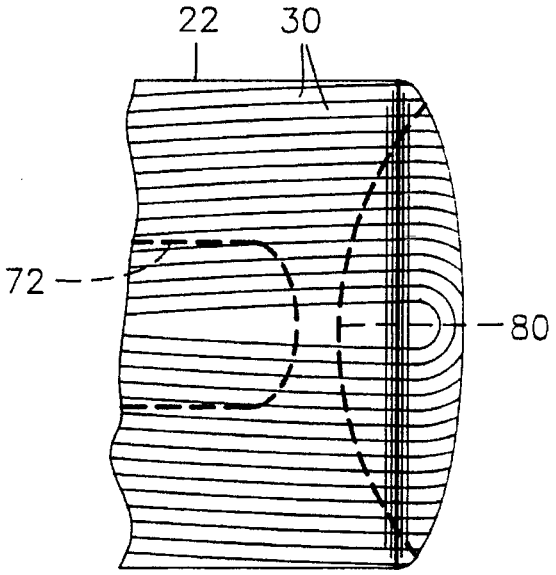
FIG. 10 is an enlarged top plan view of the barrel end portion of a bat in accordance with the present invention illustrating longitudinal wood grain and longitudinal edges of the laminates.
Figure 11:
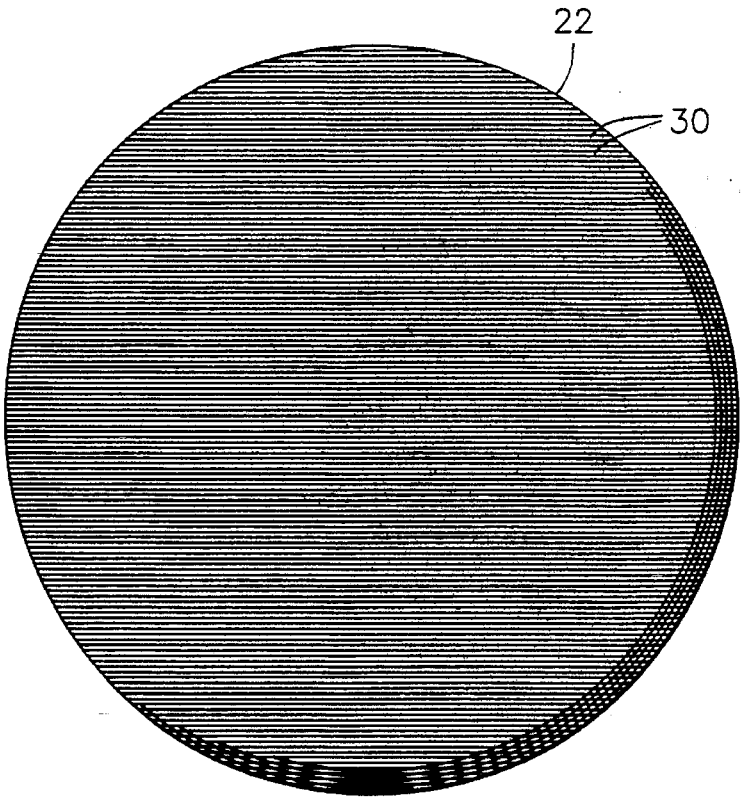
FIG. 11 is an end view of the barrel end of a bat of the present invention illustrating the laminates.

FIG. 10 is an enlarged view of the external surface of the bat illustrating the longitudinal edges of the wood veneer sheets 30 and also illustrating the orientation of the wood grain of the outermost wood veneer sheets when a square full thickness bat billet 62 using longitudinal wood grain in each veneer sheet is formed into the cylindrical transverse cross-section of the bat 20. FIGS. 10 and 11 illustrate the convex contour of the tip end of the bat with FIG. 11 illustrating more specifically the orientation of the wood veneer sheets or laminates 30. The barrel end of the bat can be cup shaped as indicated by the dotted line 80 in FIG. 10 by terminating the core 72 about two inches from the end of the bat with the concave cup shaped end being approximately one inch deep thereby further enabling optimum orientation of the balance point of the bat and providing variation in the total weight.

The construction of the laminated wood bat from wood veneer sheets is cost competitive with a wood bat from a one piece billet cut from a tree in view of the increased strength characteristics resulting in a substantial increase in the useful life expectancy of the laminated bat. Also, the structure of the bat and the method of forming the bat enables more bats to be formed from a single tree by enabling parts of the Ash tree not formerly usable to be used in making bats. Further, the use of the curable glue and its penetration into the wood veneer sheets enables other woods, such as Poplar, to be used in making wood bats. The laminated wood bat is substantially stronger than a conventional wood bat and substantially reduces breakage due to its increase in strength as compared to a conventional wood bat. In addition to the laminated construction increasing the strength, the compression and densifying of the wood fibers in the porous veneer sheets 30 due to the pressure exerted by the press also materially increases the strength characteristics of laminated bats. Even if the laminated wood bat breaks, it does not split or break into separate components, one or both of which frequently fly towards other players or into the stands. Rather, the laminated wood bat will bend with the glue maintaining the laminates in connected relation thus introducing a substantial safety factor when using the laminated wood bat. By using wood veneer sheets which are bonded together to form laminated half thickness panels 40 which are then bonded together to form a full thickness billet panel 60, a plurality of full thickness billets 62 can be formed with the bat 20 then formed into final shape by use of a lathe. This enables the balance point of the bat and the total weight of the bat to be accurately determined by utilizing the core 72 which is optionally filled when assembling panels 40.

Figure 14:
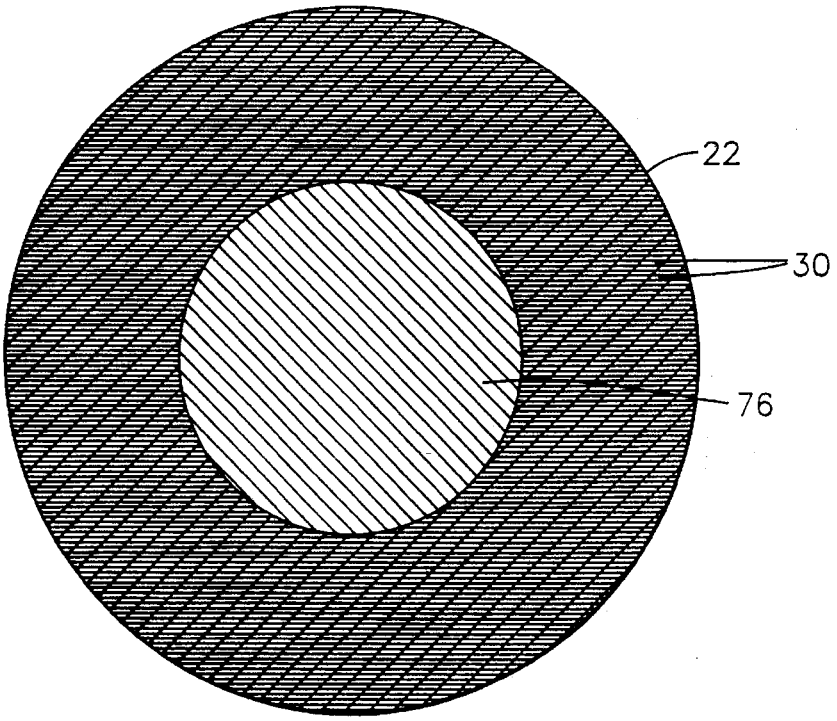
FIG. 14 is a sectional view similar to FIG. 9 but illustrating the core filled with a material more dense than the wood laminates, such as metal to provide desired weight and balance characteristics in accordance with the present invention.
Figure 12:
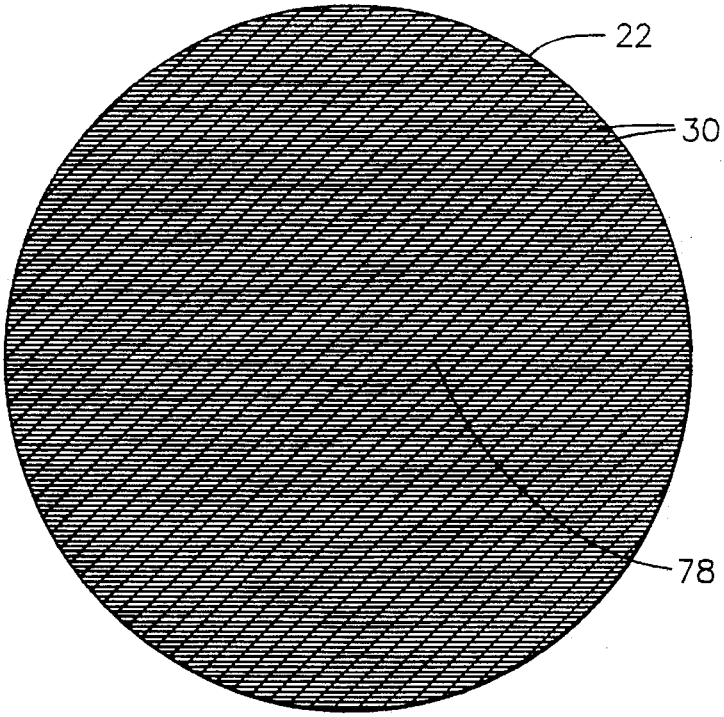
FIG. 12 is a sectional view similar to FIG. 9 but illustrating the laminates being continuous and no core being provided in the bat in accordance with the present invention.
Figure 13:
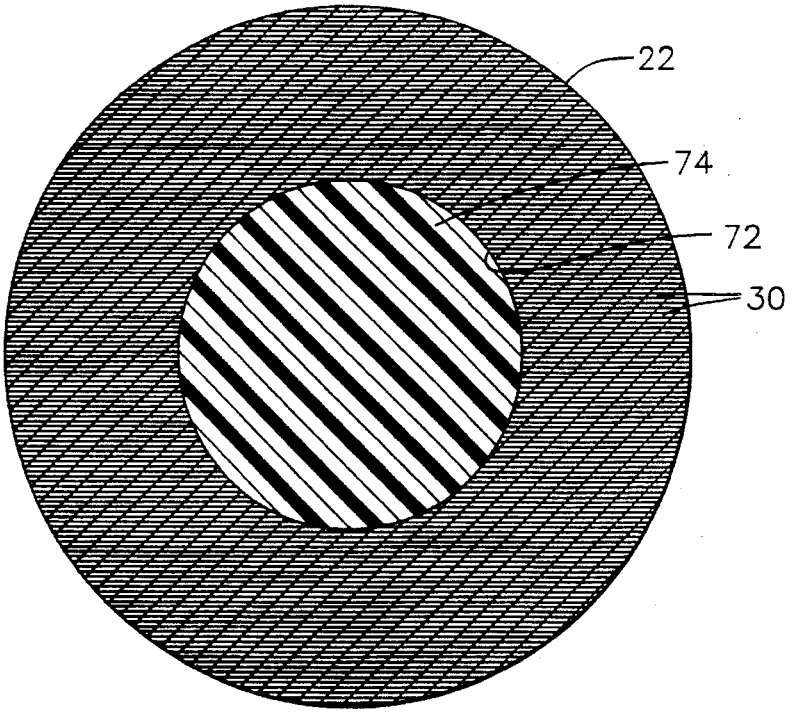
FIG. 13 is a sectional view similar to FIG. 9 but illustrating the core filled with a less dense material such as foam plastic or other lightweight material, in accordance with the present invention.

As illustrated in FIG. 9, the core 72 is hollow. However, the core can be filled with a material that is less dense than the wood veneer, such as by the use of foam plastic 74, as illustrated in FIG. 13. Suitable materials are foam urethane, foam rubber, or similar foam plastics available from many commercial sources. The foam plastic controls the weight of the bat to that of a standard Ash wood bat. Alternatively, the core may be filled with material that is more dense than the wood, such as by the use of metal 76 or other more dense material as illustrated in FIG. 14. Also, the core 72 can be completely eliminated by omitting the steps of forming the recesses or grooves 46 in the half thickness panels 40 thus providing a bat that is provided with laminates 78 which are continuous transversely of the bat as illustrated in FIG. 12. Thus, the core 72 can be any length and any size, less dense than the laminates or more dense than the laminates, or the core area may be solid with the laminates being continuous which enables the weight, balance and strength characteristics of the laminated bat to be optimized. Similarly, the bat of this invention can be made without recesses 47 and hollow recess 73, although recess 73 and reinforcing rod 82 therein are preferred. The porosity of the wood veneer sheets 30 enables the glue content to be up to approximately 25% of the total weight. It has been found that the finished bat 20 is up to approximately eight times more resistant to breakage than a conventional Ash wood bat due to compression and densification of the veneer sheets, penetration of the glue and curing the glue to permanently bond the laminates.

The foregoing is considered as illustrative only of the principles of the invention. Further, numerous modifications and changes will readily occur to those skilled in the art. For example, in forming a solid laminate bat without core 72, or recess 73, it may not be necessary to form two separate half thickness panels. Rather, panel 40 can be formed into full size thickness in one operation without departing from the instant invention. Similarly, if core 72 or recess 73, or both, are to be formed, it is possible that the full size panel could be formed by assembling partial panels that are not half size, but are made up of three or more thicknesses having grooves or openings properly aligned. Furthermore, some of the dimensions described herein are preferred but can be varied depending upon the final bat configuration without departing from the invention so long as the laminate thickness stay within the range of about 1/64 inch to about ½ inch. As such, it is not desired to limit the invention to the exact construction and operation shown and described and, accordingly, all suitable modifications and equivalents may be resorted to, falling within the scope of the invention.

What is claimed as new is as follows:

1. A laminated wood ball bat comprising a plurality of discrete thin wood veneer strips, said strips extending longitudinally of the bat in generally parallel relation and bonding material bonding said strips to each other to form said laminated bat, said wood veneer strips having longitudinal edge portions terminating at transversely remote surfaces of the bat, said bat including a barrel, a barrel end and a handle with the barrel defining a hitting zone for the bat, said barrel including a hollow core internally thereof and extending longitudinally of the barrel, said hollow core being generally centered in the barrel with respect to the outer periphery of the barrel of the bat and spaced from the barrel end of the bat, said hollow core being formed by a plurality of said veneer strips having continuous outer edge portions and a void central portion defining the hollow core, said void central portions having one end terminating inwardly of the barrel end of said bat and an opposite end terminating toward the handle of said bat, said outer edge portions of said veneer strips including longitudinally and transversely continuous end portions defining a continuous barrel end.

2. The bat as defined in claim 1 wherein each of said wood veneer strips includes wood grain, some of, all of or every other wood veneer strip having wood grain extending between different opposite edges of the wood veneer strips.

3. The bat as defined in claim 1 wherein said wood veneer strips have porous surfaces to enable penetration of said bonding material into the wood veneer strips and compression and densification of said veneer strips.

4. The bat as defined in claim 1 wherein said hollow core includes a filling material less dense and of lighter weight than the remainder of the bat to enable the balance and weight characteristics of the bat to be varied.

5. The bat as defined in claim 1 wherein said hollow core includes filling material more dense and heavier than the remainder of the bat to enable the balance and weight characteristics of the bat to be varied.

6. The bat as defined in claim 1 including a hollow recess in said handle of said bat and a reinforcing rod in said recess to reinforce said handle.

7. The bat as defined in claim 1 wherein said veneer strips are continuous elongate rectangles except for said void central portions, said bat being defined by two half bat sections, each half bat section including a plurality of veneer strips bonded together, said void central portions being defined by a groove formed in a surface of each half bat section, said grooves being in registry and defining a continuous internal surface for said core.

8. The bat as defined in claim 7 wherein said hollow core provides an optimum balance point of the bat by varying the size, shape, orientation and density of the hollow core.

9. The bat as defined in claim 3 wherein penetration of said bonding material into the porous veneer strips and compression and densification of said veneer strips materially increases the strength characteristics of the bat.

10. The bat as defined in claim 1 wherein each of said thin wood veneer strips have a substantially constant thickness within a range between about ⅛ inch and about ¼ inch.

11. A laminated wood bat having a barrel and a handle which comprises an upper longitudinal half bat and a lower longitudinal half bat each extending the full length of the bat and bonded together along mating surfaces, each said half bat made of a plurality of longitudinally extending discrete thin wood strips in generally parallel relation bonded to each other and terminating transversely at opposite surfaces of the bat, said upper longitudinal half bat having a generally longitudinal first groove along its mating surface in the barrel of said bat, said lower longitudinal half bat having a generally longitudinal second groove along its mating surface in the barrel of said bat and substantially in registry with said first groove to form a hollow core inside the barrel of said bat, said grooves spaced inwardly from all outer surfaces of the bat and all said thin wood strips being longitudinally and transversely continuous except at said grooves.

12. The bat as defined in claim 11 wherein said thin wood strips have a thickness range between about ⅛ inch and about ¼ inch.

13. The bat as defined in claim 11 wherein each of said wood strips includes wood grain, some of, all of or every other wood strip having wood grain extending between different opposite edges of the wood strips.

14. The bat as defined in claim 11 wherein said wood strips have porous surfaces to enable penetration of bonding material into the wood strips and compression and densification of said wood strips.

15. The bat as defined in claim 11 wherein said hollow core includes a filling material less dense and of lighter weight than the remainder of the bat to enable the balance and weight characteristics of the bat to be varied.

16. The bat as defined in claim 11 wherein said hollow core includes filling material more dense and heavier than the remainder of the bat to enable the balance and weight characteristics of the bat to be varied.

17. The bat as defined in claim 11 including a hollow recess in said handle of said bat and a reinforcing rod in said recess to reinforce said handle.

* * * * *